US005078166A

United States Patent [19]

Lee

[11] Patent Number: 5,078,166

[45] Date of Patent: Jan. 7, 1992

[54] UMBRELLA WITH A WIND ESCAPE

[76] Inventor: Wen P. Lee, 39-12 51st St., 2nd Floor, Woodside, N.Y. 11377

[21] Appl. No.: 557,469

[22] Filed: Jul. 25, 1990

[51] Int. Cl.[5] ..... A01G 1/00

[52] U.S. Cl. ..... 135/33.7

[58] Field of Search ..... 135/33.7, 33.71, 25.1, 135/29 M, 35 V

[56] References Cited

U.S. PATENT DOCUMENTS

| | | | |
|---|---|---|---|
| 212,457 | 2/1879 | Girbardt | 135/35 V |
| 312,446 | 2/1885 | Drake | 135/35 V |
| 617,415 | 1/1899 | Eatman | 135/35 V |
| 1,088,743 | 3/1914 | Swinland | 135/35 V |
| 1,723,044 | 8/1929 | Khalil | 135/35 V |
| 3,467,115 | 9/1969 | Brooks | 135/25 R |

*Primary Examiner*—Henry E. Raduazo
*Attorney, Agent, or Firm*—Richard L. Miller

[57] ABSTRACT

An umbrella having a wind escape opening is provided and consists of a collapsible frame structure supporting a two tiered canopies with the wind escape opening therebetween so that the umbrella can be handled better and steadier in the wind without the wind causing destruction to the embrella while at the same time protecting the user from the rain.

2 Claims, 1 Drawing Sheet

UMBRELLA WITH A WIND ESCAPE

BACKGROUND OF THE INVENTION

The instant invention relates generally to umbrellas and more specifically it relates to an umbrella having a wind escape opening.

Numerous umbrella have been provided in the prior art that are adapted to protect people from the weather, each normally consisting of a collapsible canopy mounted on a central rod. While these units may be suitable for the particular purpose to which they address, they would not be as suitable for the purpose of the present invention as hereafter described.

SUMMARY OF THE INVENTION

A primary object of the present invention is to provide an umbrella having a wind escape opening that will overcome the shortcomings of the prior art devices.

Another object is to provide an umbrella having a wind escape opening in which the umbrella can be handled better and steadier in the wind, without destruction to the umbrella by the wind.

An additional object is to provide an umbrella having a wind escape opening between a two tiered canopy frame configuration in which the two tiered canopy can be folded up when not being used.

A further object is to provide an umbrella having a wind escape opening that is simple and easy to use.

A still further object is to provide an umbrella having a wind escape opening that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only and that changes may be made in the specific construction illustrated and described within the scope of the appended claims.

BRIEF DESCRIPTION OF THE DRAWING FIGURES

The figures in the drawings are briefly described as follows.

DETAILED DESCRIPTION OF THE PREFERRED EMBODIMENTS

Figure 1:
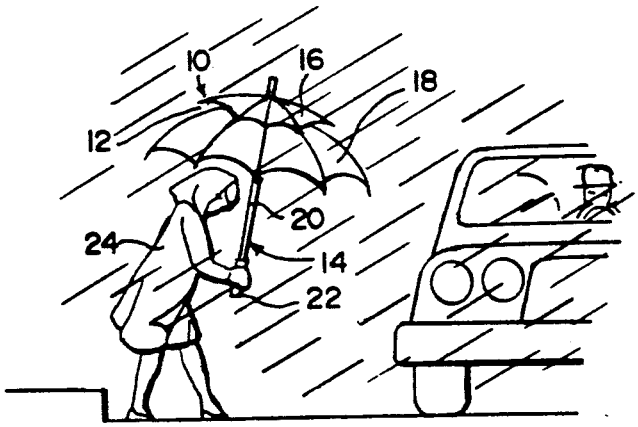
FIG. 1 is a side elevational view of the instant invention being used in a rain storm.
Figure 2:
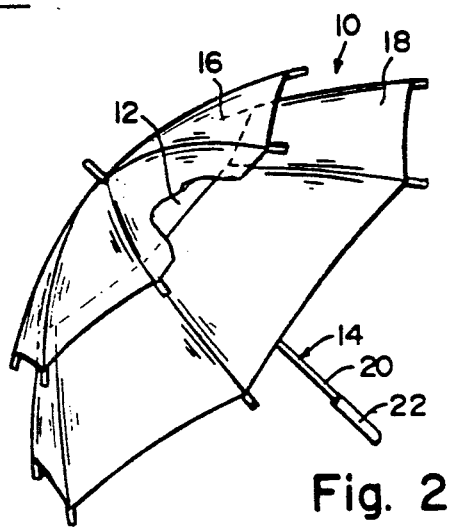
FIG. 2 is a perspective view of the instant invention with parts broken away showing the wind escape opening.

Turning now descriptively to the drawings, in which like reference characters denote like elements throughout the several views, the Figures illustrate an umbrella 10 having a wind escape opening 12 consisting of a collapsible frame structure 14 supporting two tiered canopies 16 and 18 with the wind escape opening 12 therebetween so that the umbrella 10 can be handled better and steadier in the wind without the wind causing destruction to the umbrella 10.

The upper canopy 16 is smaller than the lower canopy 18 and is spaced away therefrom so as to form the wind escape opening 12 therebetween allowing the wind to pass therethrough when the frame structure 14 is in its opened position.

Figure 3:
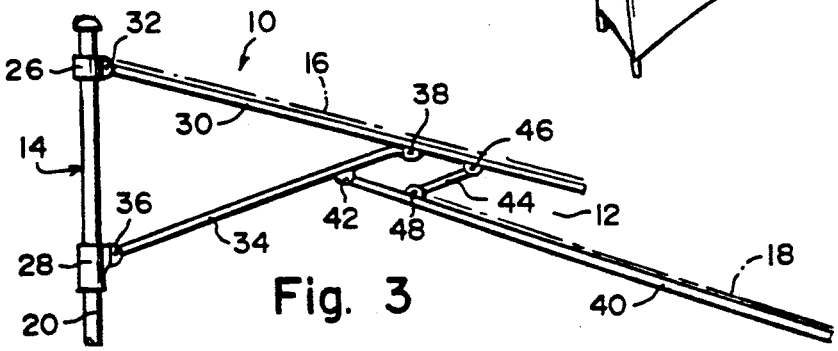
FIG. 3 is an elevational view of the frame structure of a first embodiment of the invention.

The collapsible frame structure 14, as best seen in FIG. 3, includes an elongated rod 20 having a handle 22 to be grasped by a person 24 using the umbrella 10. An inside cap 26 is affixed to the top of the rod 20 and a runner 28 is slideable on the rod 20. A plurality of upper ribs 30 are each radially pivotally affixed at its inner end 32 to the inside cap 26 to support the upper canopy 16. A plurality of stretches 34 are each radially pivotally affixed at its inner end 36 to the runner 28 and pivotally affixed at its inner end 36 to the runner 28 and pivotally affixed at its outer end 38 to the one upper rib 30. A plurality of lower ribs 40 are each pivotally affixed at its inner end 42 to one stretcher 34 to support the lower canopy 18. A plurality of intermediate short ribs 44 are each pivotally affixed at both ends 46 and 48 between one upper rib 30 and one lower rib 40 to keep the wind escape opening 12 formed therebetween.

Figure 4:
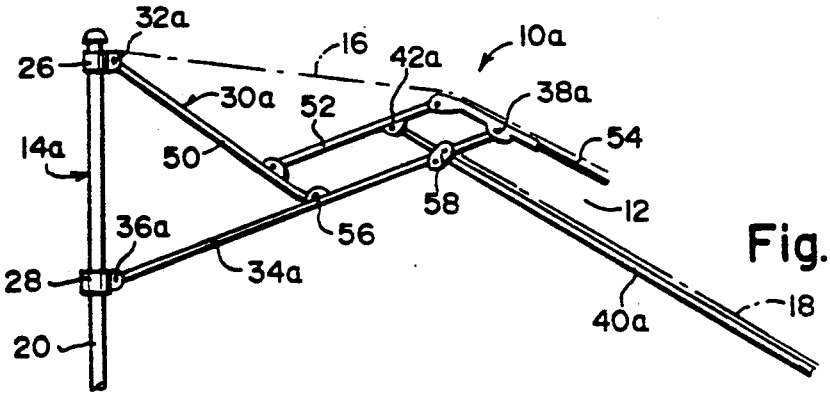
FIG. 4 is an elevational view of the frame structure of a second embodiment of the invention.

FIG. 4 shows another type of collapsible frame structure **14*a* in which each upper rib 30*a* is segmented into three pivotal members 50, 52 and 54 in which the inner member 50 is pivotally affixed at its inner end 32*a* to the inside cap 26 to support the upper canopy 16. Each stretcher 34*a* is radially pivotally affixed at its inner end 36*a* to the runner 28, is pivotally affixed at its center 56 to the inner member 50 of the upper rib 30*a* and is pivotally affixed at its outer end 38*a* to the outer member 54 of the upper rib 30*a*. Each lower rib 40*a* is pivotally affixed at its inner end 42*a* to the middle member 52 of the upper rib 30*a* and at 58 to the stretcher 34*a* to support the lower canopy 18 to keep the wind escape opening 12** formed therebetween.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. An umbrella having a wind escape opening comprising a collapsible frame structure supporting two tiered canopies with said wind escape opening therebetween so that said umbrella can be handled better and steadier in the wind without the wind easily causing destruction to said umbrella, wherein an upper canopy is smaller than a lower canopy and spaced away therefrom so as to form said wind escape opening therebetween allowing the wind to pass therethrough when said frame structure is in its open position, wherein said collapsible frame structure includes:

a) an elongated rod having a handle to be grasped by a person using said umbrella;

b) an inside cap affixed to the top of said rod;

c) a runner slideable on said rod;

d) a plurality of upper ribs, each radially pivotally affixed at its inner end to said inside cap to support said upper canopy;

e) a plurality of stretchers, each radially pivotally affixed at its inner end to said runner and pivotally affixed at its outer end to said one upper rib;

f) a plurality of lower ribs, each pivotally affixed at its inner end to one said stretcher to support said lower canopy; and g) a plurality of intermediate short ribs, each pivotally affixed to both ends between one said upper rib and one said lower rib to keep said wind escape opening formed therebetween.

2. An umbrella having a wind escape opening comprising a collapsible frame structure supporting two tiered canopies with said wind escape opening therebetween so that said umbrella can be handled better and steadier in the wind without the wind easily causing destruction to said umbrella, wherein an upper canopy is smaller than a lower canopy and spaced away therefrom so as to form said wind escape opening therebetwen allowing the wind to pass therethrough when said frame structure is in its open position, wherein said collapsible frame structure includes:

a) an elongated rod having a handle to be grasped by a person using said umbrella;

b) an inside cap affixed to the top of said rod;

c) a runner slideable on said rod;

d) a plurality of upper ribs, each segmented into three pivotal members in which the inner members is pivotally affixed at its inner end to said inside cap to support said upper canopy;

e) a plurality of stretchers, each radially pivotally affixed at its center to said inner member of said one upper rib, and pivotally affixed at its outer end to the outer member of said one upper rib; and f) a plurality of lower ribs, each pivotally affixed at its inner end to the middle member of said one upper rib and one said stretcher to support said lower canopy to keep said wind escape opening formed therebetween.

* * * * *